United States Patent [19]

Yamashita

[11] Patent Number: 4,878,414

[45] Date of Patent: Nov. 7, 1989

[54] MUSICAL INSTRUMENT STAND

[75] Inventor: Toshinori Yamashita, Hamamatsu, Japan

[73] Assignee: Yamaha Corporation, Hamamatsu, Japan

[21] Appl. No.: 308,668

[22] Filed: Feb. 10, 1989

[30] Foreign Application Priority Data

Feb. 12, 1988 [JP] Japan ..... 63-16268[U]

[51] Int. Cl.[4] ..... G10G 5/00

[52] U.S. Cl. ..... 84/421; 84/422.3

[58] Field of Search ..... 84/421, 422.3

[56] References Cited

U.S. PATENT DOCUMENTS 3,780,613 12/1973 Ludwig ..... 84/421
4,126,075 11/1978 Kurosaki ..... 84/421
4,158,980 6/1979 Gauger ..... 84/421
4,526,083 7/1985 Le Mert ..... 84/421

FOREIGN PATENT DOCUMENTS 53-12579 4/1978 Japan .
61-29397 2/1986 Japan .

*Primary Examiner*—Lawrence R. Franklin
*Attorney, Agent, or Firm*—Burns, Doane, Swecker & Mathis

[57] ABSTRACT

A percussion instrument stand includes a percussion instrument holding unit including at least one hollow pipe (5, 20) for holding a percussion instrument, a leg unit (2, 7) for supporting the hollow pipe in a predetermined state, and a vibration damper (13) filled in the hollow pipe.

9 Claims, 5 Drawing Sheets

MUSICAL INSTRUMENT STAND

BACKGROUND OF THE INVENTION

The present invention relates to a musical instrument stand suited for use in a performance of a percussion instrument such as a drum or a cymbal.

A conventional musical instrument stand of this type on which a percussion instrument such as a drum, a cymbal, a cow bell, an electronic drum or an electronic cymbal is mounted and which is set on a floor surface is made of a metal pipe consisting of steel, stainless steel, aluminum or the like. For this reason, if a striking vibration produced upon a musical instrument performance has a frequency equal or approximate to a resonance frequency of the stand pipe, the pipe resonates to adversely affect the performance. In addition, the striking vibration is transmitted to the floor surface through the stand or an external vibration is transmitted to the stand through the floor surface. A known method of solving these problems is a musical instrument stand in which the surface of a leg member constituting a stand leg is covered with a soft material such as rubber as disclosed in Japanese Utility Model Laid-Open No. 61-29397.

In such a conventional musical instrument stand, however, although the transmission of a vibration from the stand leg to the floor surface or vice versa can be prevented to a certain extent, the resonance of a musical instrument holding pipe on which a percussion instrument is mounted and to which a striking vibration of the percussion instrument is directly transmitted cannot be prevented. Therefore, a demand has arisen for a countermeasure capable of solving this problem.

SUMMARY OF THE INVENTION

It is, therefore, an object of the present invention to solve the above conventional problems and to provide a musical instrument stand capable of preventing a resonance of a musical instrument holding pipe with a simple structure.

In order to achieve the above object of the present invention, there is provided a percussion instrument stand comprising a musical instrument holding means including at least one hollow pipe (5, 20) for holding a percussion instrument, a leg means (2, 7) for supporting the hollow pipe in a predetermined state, and a vibration damper (13) filled in the hollow pipe.

DETAILED DESCRIPTION OF THE PREFERRED EMBODIMENT

Embodiments of the present invention will be described below with reference to the accompanying drawings.

Figure 1:
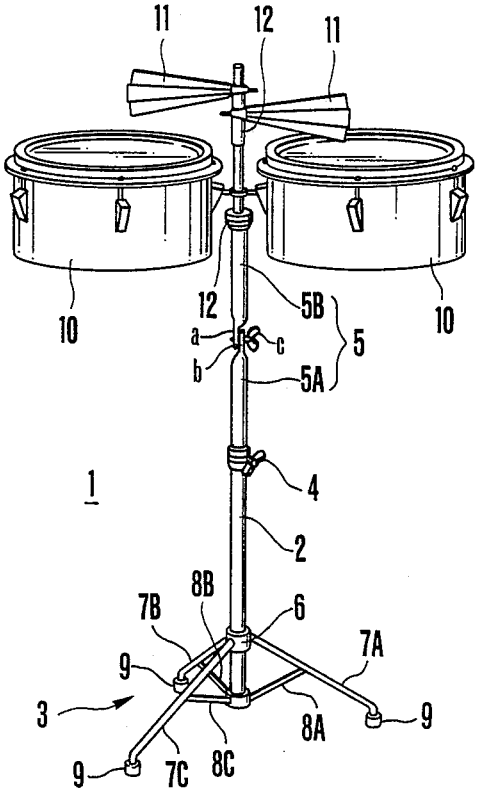
FIG. 1 is a perspective view showing an embodiment of a musical instrument stand according to the present invention.
Figure 2:
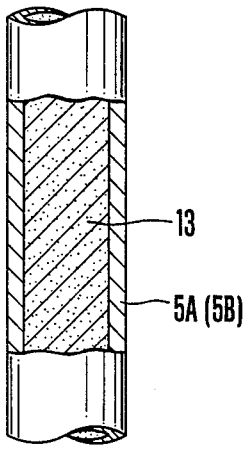
FIG. 2 is a sectional view showing a main part of a musical instrument holding pipe.

FIG. 1 is a perspective view showing an embodiment of a musical instrument stand according to the present invention, and FIG. 2 is a sectional view showing a main part of a musical instrument holding pipe. Referring to FIGS. 1 and 2, a musical instrument stand generally denoted by reference numeral 1 comprises a lower pipe 2, a foldable stand leg unit 3 for holding the lower end portion of the lower pipe 2, and a musical instrument holding pipe 5. The lower end portion of the musical instrument holding pipe 5 is slidably inserted in the lower pipe 2, and its height is adjusted by a thumbscrew 4. Although these pipes 2, 5 are normally made of a metal, they may be made of another material such as plastics as long as the strength sufficient to hold a musical instrument is assured. The stand leg unit 3 comprises three stand legs 7A, 7B and 7C connected to the circumferential surface of the lower pipe 2 so as to be freely opened/closed through a coupling ring 6, and three stays 8A, 8B and 8C for connecting middle portions of the stand legs 7A, 7B and 7C to the lower end of the lower pipe 2, respectively. A foot member 9 made of, e.g., rubber is fitted on the distal end of each of the stand legs 7A, 7B and 7C.

The musical instrument holding pipe 5 comprises an intermediate pipe 5A, and an upper pipe 5B pivotally mounted on the upper end of the intermediate pipe 5A so that an angle of the upper pipe 5B can be adjusted in a vertical plane. Two tom-toms 10 and two cow bells 11 are mounted on the upper pipe 5B through mounting metal pieces 12. A mechanism for adjusting the angle comprises, as shown in FIG. 1, connecting portions a and b obtained by flattening the ends of the pipes 5A and 5B and a connecting screw c to be threadably engaged with a hole formed in the connecting portions. The upper pipe 5B is pivoted through an arbitrary angle about the connecting screw c to adjust the angle. A vibration damper 13 such as urethane foam, felt, glass-wool or rubber is filled in the intermediate and upper pipes 5A and 5B so that resonance frequencies of the pipes 5A and 5B do not resonate with the frequency of the tom-toms 10 or the cow bells 11. Therefore, upon a performance of the tom-toms 10 or the cow bells 11, even if a striking vibration is transmitted to the musical instrument holding pipe 5 through the mounting metal piece 12, the intermediate or upper pipe 5A or 5B does not resonate. In addition, since the vibration damper 13 itself absorbs and attenuates the striking vibration, striking vibration transmitted to the floor surface through the stand leg unit 3 are reduced. Also, since the vibration damper 13 is filled in the intermediate and upper pipes 5A and 5B, sufficient strength and rigidity can be assured without changing the outer diameter of the pipes 5A and 5B. That is, if the vibration damper 13 is formed on the outer surface of the pipe, since the outer diameter is increased by the thickness of the damper, the inner and outer diameters of the lower pipe 2 must be increased. As a result, the size and weight of the entire stand are increased. In order not to change the inner and outer diameters of the lower pipe 2, the outer diameter of the musical instrument holding pipe 5 must be decreased by the thickness of the vibration damper 13. In this case, however, the strength and rigidity of the pipe 5 itself are degraded. In this point of view, according to the present invention, since the vibration damper is filled in the pipes as described above, the inner and outer diameters of the pipe 5 need not be changed and therefore conventional products can be directly used.

Figure 3:
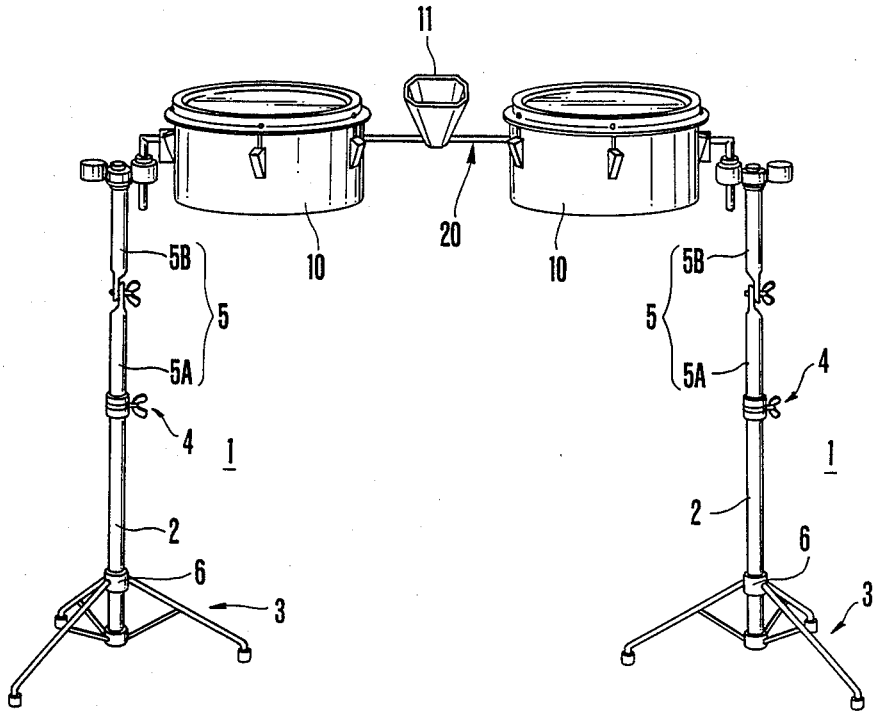
FIG. 3 is a perspective view showing another embodiment of the present invention.
Figure 4:
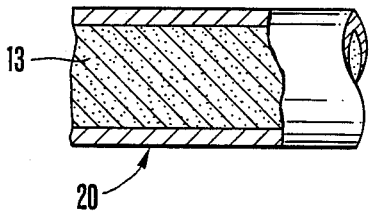
FIG. 4 is a sectional view showing a main part of a coupling pipe.

FIG. 3 is a perspective view showing another embodiment of the present invention, and FIG. 4 is a sectional view showing a main part of a coupling pipe. In this embodiment, two musical instrument stands 1 are aligned on a floor surface, and the upper ends of upper pipes 5B of the stands 1 are connected through a transverse coupling pipe 20. Two tom-toms 10 and a cow bell 11 are mounted on the pipe 20 through mounting metal pieces (not shown), and a vibration damper 13 is filled in the pipe 20. In this case, similar to the musical instrument holding pipe 5 in the embodiment shown in FIG. 1, the coupling pipe 20 constitutes a musical instrument holding pipe. In addition, a vibration damper is similarly filled in intermediate and upper pipes 5A and 5B as in the above first embodiment. This arrangement is necessary when the musical instrument stands 1 are used independently of each other.

Note that in the above embodiments, sectional shapes of the musical instrument holding pipes 5 and 20 are circular. The sectional shape, however, is not limited to circular but may be rectangular, elliptic or the like.

Also, in the above embodiments, the musical instrument holding pipe 5 comprises the intermediate pipe 5A and the upper pipe 5B. The pipe 5, however, may be a continuous single pipe.

Figure 5:
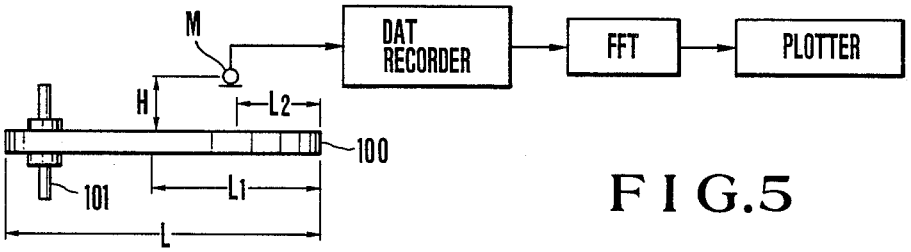
FIG. 5 is a schematic view showing a test apparatus used in the present invention.
Figure 6A:
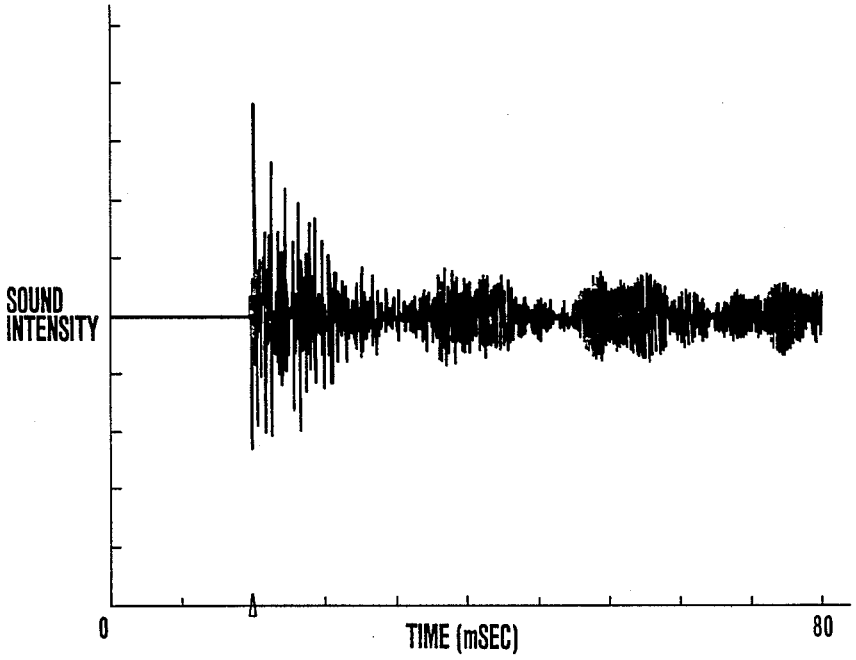
FIGS. 6A and 6B are graphs showing damping characteristics of another conventional steel pipe.
Figure 6B:
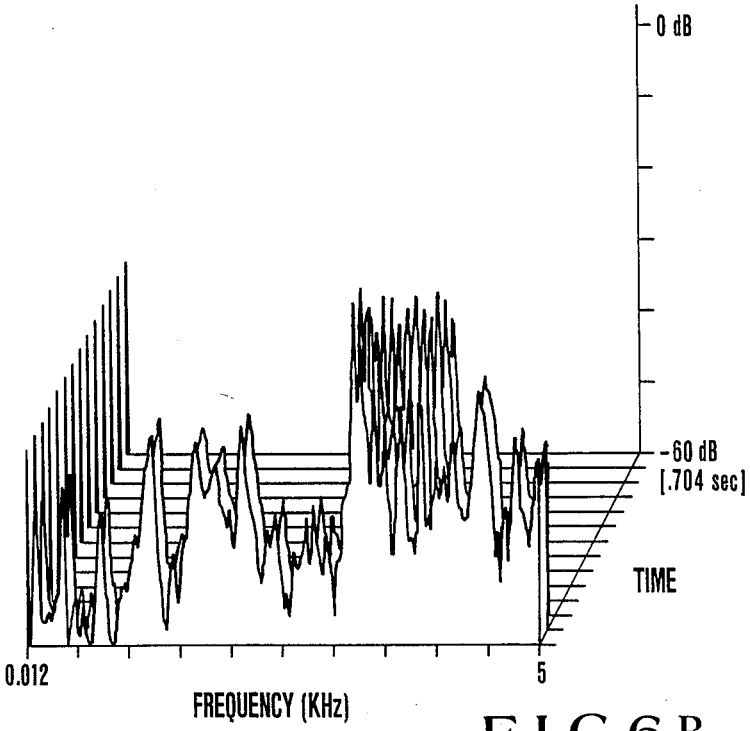
Figure 7A:
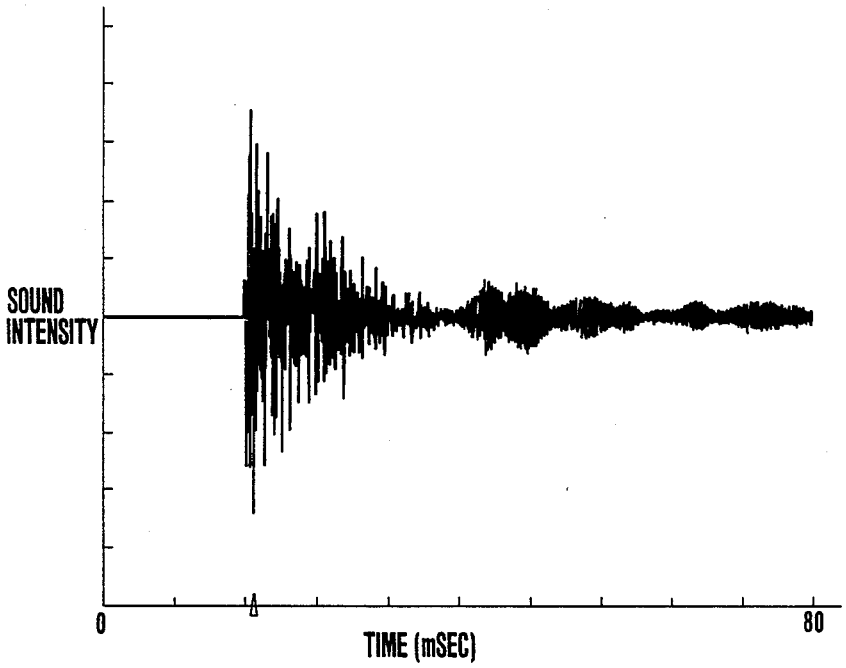
FIGS. 7A and 7B are graphs and showing damping characteristics of another conventional steel pipe.
Figure 7B:
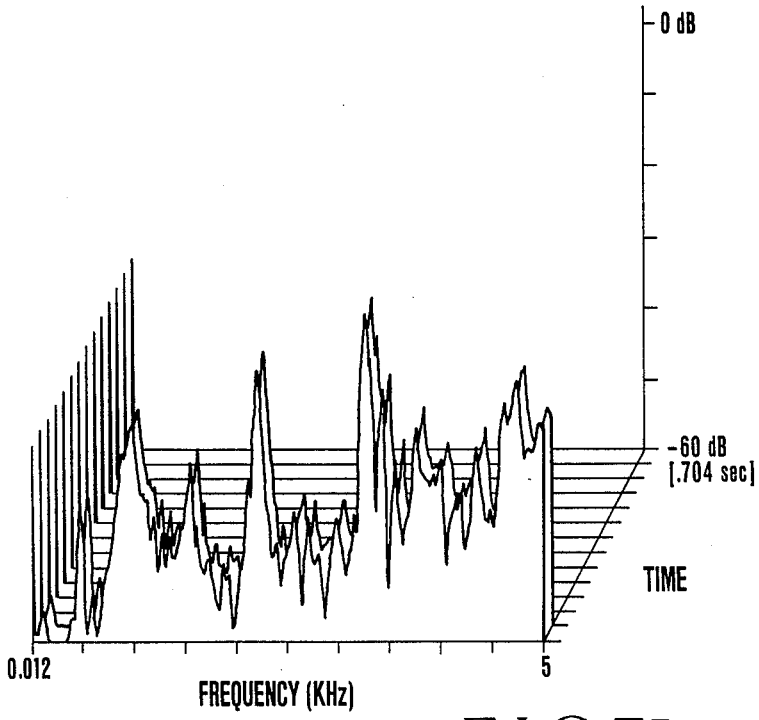
Figure 8A:
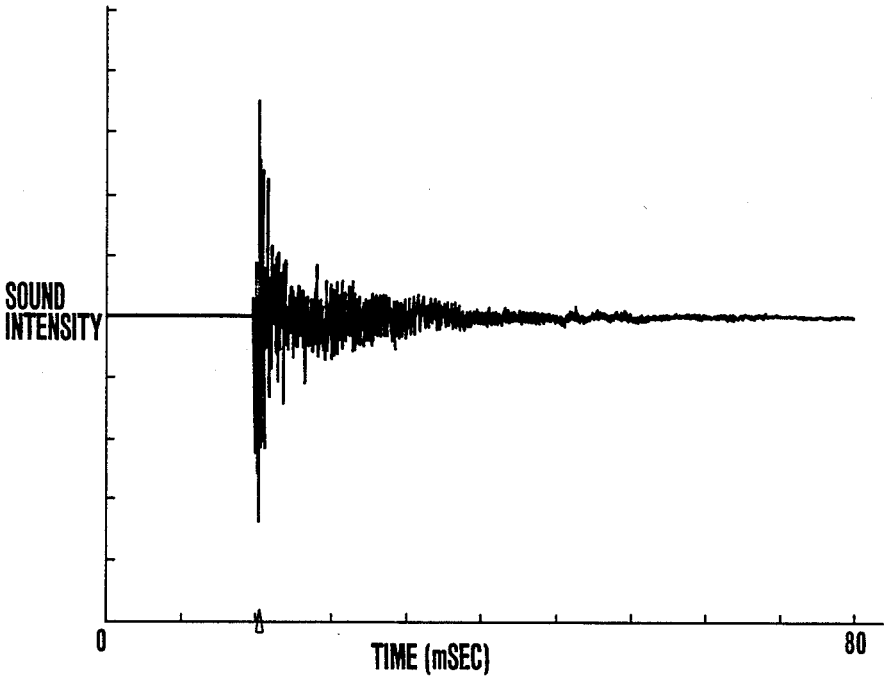
FIGS. 8A and 8B are graphs showing damping characteristics of a steel pipe of the present invention.
Figure 8B:
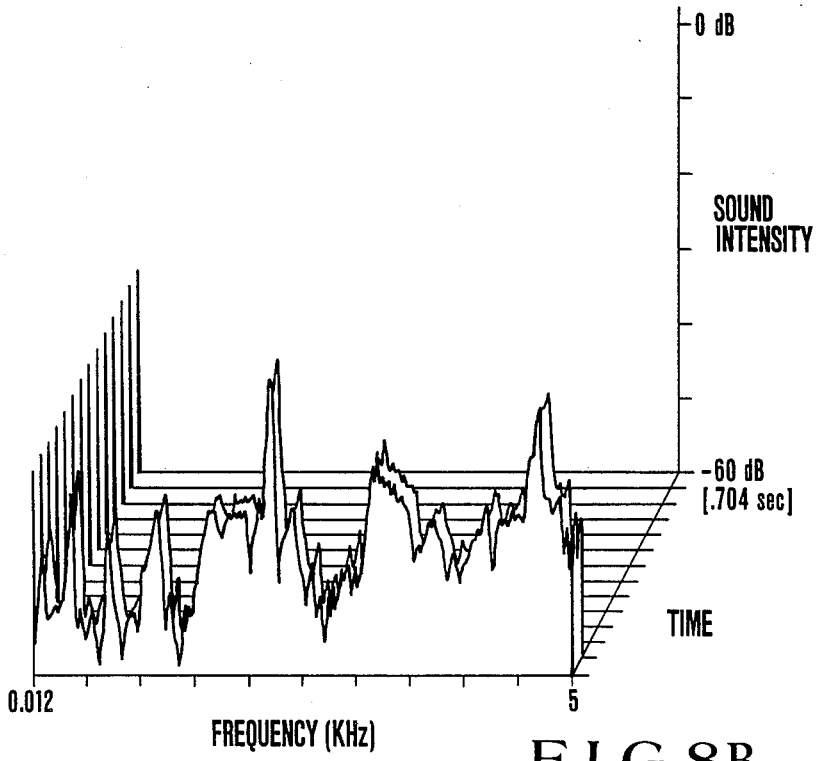

In order to check the effects of the present invention, tests were conducted using a test apparatus as shown in FIG. 5. The results are shown as damping characteristics in FIGS. 6A to 8B. Referring to FIG. 5, a material to be tested 100 is cantilevered at its left end by a suitable supporting member 101. As the material to be tested 100, a steel pipe having a length L of 115 cm, an inner diameter of 29.4 mm and an outer diameter of 31.4 mm was used. A microphone M is located at a position separated from the right end of the material to be tested by $L_2=L/4$ at a height H of 5 cm. The damping characteristics shown in FIGS. 6A to 8B were obtained from the microphone M via a DAT recorder DR, a high-speed Fourie transformer FFT and a plotter. FIGS. 6A and 6B show the characteristics obtained by a conventional steel pipe 100 in which no urethane foam as in the present invention is filled, FIGS. 7A and 7B show the characteristics obtained by a conventional steel pipe 100 the outer surface of which is coated with a vinyl chloride resin, and FIGS. 8A and 8B show the characteristics obtained by a steel pipe 100 in which urethane foam (specific gravity=0.10 to 0.12) is filled. In each of FIGS. 6A, 7A and 8A, the abscissa X represents a time and the ordinate Y represents sound intensity. In each of FIGS. 6B, 7B and 8B, the abscissa X represents a frequency, the ordinate Y represents sound intensity and the depth axis Z represents a time. The above characteristics were obtained by slightly striking a position (central portion) separated from the right end by $L_1=L/2$ with a wood stick. As is apparent from FIGS. 6A to 8B, the present invention improves the damping characteristics and prevents the pipe from resonating.

As has been described above, according to the musical instrument stand of the present invention, the vibration damper is filled in the musical instrument holding pipe on which a percussion instrument is mounted. Therefore, the vibration damper effectively absorbs and attenuates a striking vibration of the percussion instrument and prevents the resonance of the pipe. As a result, a performance is not adversely affected, and a vibration transmitted to a floor surface or an external vibration transmitted from the floor surface to the percussion instrument through the musical instrument holding pipe can be minimized. In addition, an outer appearance and a size of the stand itself are not changed at all. That is, the musical instrument stand according to the present invention is very effective in practical use especially for an electronic percussion instrument incorporating a vibration detector.

What is claimed is:

1. A percussion instrument stand comprising:

musical instrument holding means including at least one hollow pipe (5, 20) for holding a percussion instrument;

leg means (2, 7) for supporting said hollow pipe in a predetermined state; and a vibration damper (13) filled in said hollow pipe.

2. A stand according to claim 1, wherein said musical instrument holding means comprises a plurality of hollow pipes (5A, 5B), said vibration damper being filled in each of said plurality of hollow pipes.

3. A stand according to claim 2, wherein a connecting portion of at least one set of said plurality of hollow pipes is a mechanism which enables an upper pipe to pivot.

4. A stand according to claim 1, wherein said vibration damper is a member selected from the group consisting of foam, felt, glass-wool and rubber.

5. A stand according to claim 1, wherein said hollow pipe is made of a metal.

6. A stand according to claim 1, wherein said leg means comprises a plurality of supporting hollow pipes (2) and legs (7A, 7B, 7C) for holding said plurality of supporting hollow pipes in a predetermined state, said musical instrument holding hollow pipe (20) extending between said plurality of supporting hollow pipes.

7. A stand according to claim 6, further comprising a vibration damper (13) filled in said plurality of supporting hollow pipes of said leg means.

8. A stand according to claim 1, wherein said vibration damper consists of urethane foam.

9. A stand according to claim 8, wherein a specific gravity of said urethane foam is 0.10 to 0.12.

* * * * *